US011603122B2

(12) United States Patent
Kanner et al.

(10) Patent No.: US 11,603,122 B2
(45) Date of Patent: Mar. 14, 2023

(54) OVER-SPEED PROTECTION DEVICE

(71) Applicant: THALES CANADA INC, Toronto (CA)

(72) Inventors: Abe Kanner, Toronto (CA); Walter Kinio, Toronto (CA); Rudy Rochefort, Toronto (CA); Firth Whitwam, Toronto (CA)

(73) Assignee: THALES CANADA INC, Toronto (CA)

( * ) Notice: Subject to any disclaimer, the term of this patent is extended or adjusted under 35 U.S.C. 154(b) by 160 days.

(21) Appl. No.: 17/018,853

(22) Filed: Sep. 11, 2020

(65) Prior Publication Data

US 2021/0078620 A1 Mar. 18, 2021

Related U.S. Application Data

(60) Provisional application No. 62/899,438, filed on Sep. 12, 2019.

(51) Int. Cl.
*B61L 3/00* (2006.01)

(52) U.S. Cl.
CPC ..... *B61L 3/008* (2013.01)

(58) Field of Classification Search
CPC ..... B61L 3/008
See application file for complete search history.

(56) References Cited

U.S. PATENT DOCUMENTS 4,279,395 A 7/1981 Boggio et al.
5,404,465 A 4/1995 Novakovich et al.
3,026,810 A1 9/2011 Engel et al.
8,260,487 B2 9/2012 Plawecki
8,365,583 B2 2/2013 Block et al.
8,935,022 B2 1/2015 Cooper et al.
8,948,996 B2 2/2015 Warkentin
9,428,159 B2 8/2016 Heise et al.
9,689,681 B2 6/2017 Napolitano et al.
(Continued)

FOREIGN PATENT DOCUMENTS

CN 107284471 A 10/2017
EP 2712783 A1 4/2014
(Continued)

OTHER PUBLICATIONS

International Search Report and Written Opinion issued in corresponding International Application No. PCT/IB2020/058399, dated Dec. 10, 2020, pp. 1-16, Canadian Intellectual Property Office, Quebec, Canada.

(Continued)

*Primary Examiner* — Peter D Nolan
*Assistant Examiner* — Demetra R Smith-Stewart
(74) *Attorney, Agent, or Firm* — Hauptman Ham, LLP

(57) ABSTRACT

An SIL 4 over-speed protection device for a rail vehicle includes a first logical unit configured to be connected to a first power source, a first speed sensor and a first vital supervision circuit and a second logical unit configured to be connected to a second power source, a second speed sensor and a second vital supervision circuit. The first logical unit is configured to determine if the second logical unit is functioning properly and the second logical unit is configured to determine if the first logical unit is functioning properly.

20 Claims, 5 Drawing Sheets

(56) References Cited

U.S. PATENT DOCUMENTS

| | | | | |
|---|---|---|---|---|
| 11,208,125 | B2 * | 12/2021 | Thiyagarajan | B61L 27/14 |
| 2012/0323411 | A1 | 12/2012 | Whitwam et al. | |
| 2013/0262064 | A1 | 10/2013 | Mazzaro et al. | |
| 2013/0325225 | A1 * | 12/2013 | Kane | B61L 3/008 701/20 |
| 2014/0129000 | A1 | 5/2014 | Block et al. | |
| 2014/0129187 | A1 | 5/2014 | Mazzaro et al. | |
| 2014/0229040 | A1 * | 8/2014 | Weber | G06F 11/1479 701/19 |
| 2015/0025716 | A1 | 1/2015 | Orion | |
| 2016/0257309 | A1 * | 9/2016 | Kumar | B60W 30/18027 |
| 2016/0359741 | A1 * | 12/2016 | Cooper | H04W 4/44 |
| 2017/0096154 | A1 | 4/2017 | Hurst | |
| 2018/0186357 | A1 * | 7/2018 | Deshpande | B60W 10/08 |
| 2019/0054909 | A1 | 2/2019 | Shah et al. | |

FOREIGN PATENT DOCUMENTS

| | | | |
|---|---|---|---|
| EP | 3281839 | A1 | 2/2018 |
| WO | 2013000063 | A1 | 1/2013 |
| WO | 2013021012 | A1 | 2/2013 |
| WO | 2017098366 | A1 | 6/2017 |
| WO | 2017186629 | A1 | 11/2017 |

OTHER PUBLICATIONS

Kahler, M., "The European Train Control System In Thales Signalling Solutions," Mechanics Transport Communications, Academic Journal, Article No. 0301, Issue 3, 2008.

Cheddie, H.L., "TurboSentry™ Overspeed Protection Device," IEC 61511 Compliance and SIL Verification Report, CTERIS Consulting, pp. 1-25.

Rumsey, A. et al., "An Assessment of the Business Case for Communications-Based Train Control," FTA Report No. 0045, Delcan Corporation, New York Rail Technology, PE PC, Sep. 2013.

Ouedraogo, K.A. et al., "Safety integrity level allocation shared or divergent practices in the railway domain," Congres de l'International Railway Safety Council (IRSC 2016), Oct. 2016, Paris, France.

Rong, H. et al., "Development and Research of Train Operation Control System and Safety Computer Platform Based on COTS," Boletin Tecnico, vol. 55, Issue 18, 2017, pp. 142-148.

* cited by examiner

OVER-SPEED PROTECTION DEVICE

PRIORITY CLAIM

The present application claims the priority of U.S. Provisional Application No. 62/899,438, filed Sep. 12, 2019, which is incorporated herein by reference in its entirety.

BACKGROUND

Over-speed protection devices provide warnings and intervention when a vehicle approaches or exceeds safe speed limits, assisting train operation personnel and train driving systems. An over-speed protection device determines when the train is in an over-speed situation, i.e., when the actual speed of the train exceeds a maximum speed of operation for a given set of parameters, e.g., track conditions, vehicle conditions, or the like. Over-speed protection devices are not used when a train is in Automatic Mode, whereby the train control system operates the train controls, but only in Manual Mode, whereby the driver operates the train controls or Cut Off Mode, whereby the driver operates the train controls under restricted conditions. When an over-speed protection device is installed in an operating train control system, which is designed to be highly available, the over-speed protection device is only rarely operational because while the train control system is operational and the train is controlled by the system, the over-speed protection device is disabled. The mean time between operation of the over-speed protection device is high, i.e., the over-speed protection device is infrequently operated due to the high availability and operation of the train control system. There is an inherent risk in the over-speed protection device being seldom used because of difficulty associated with testing or otherwise assessing the functionality of a disabled over-speed protection device.

DETAILED DESCRIPTION

Figure 1:
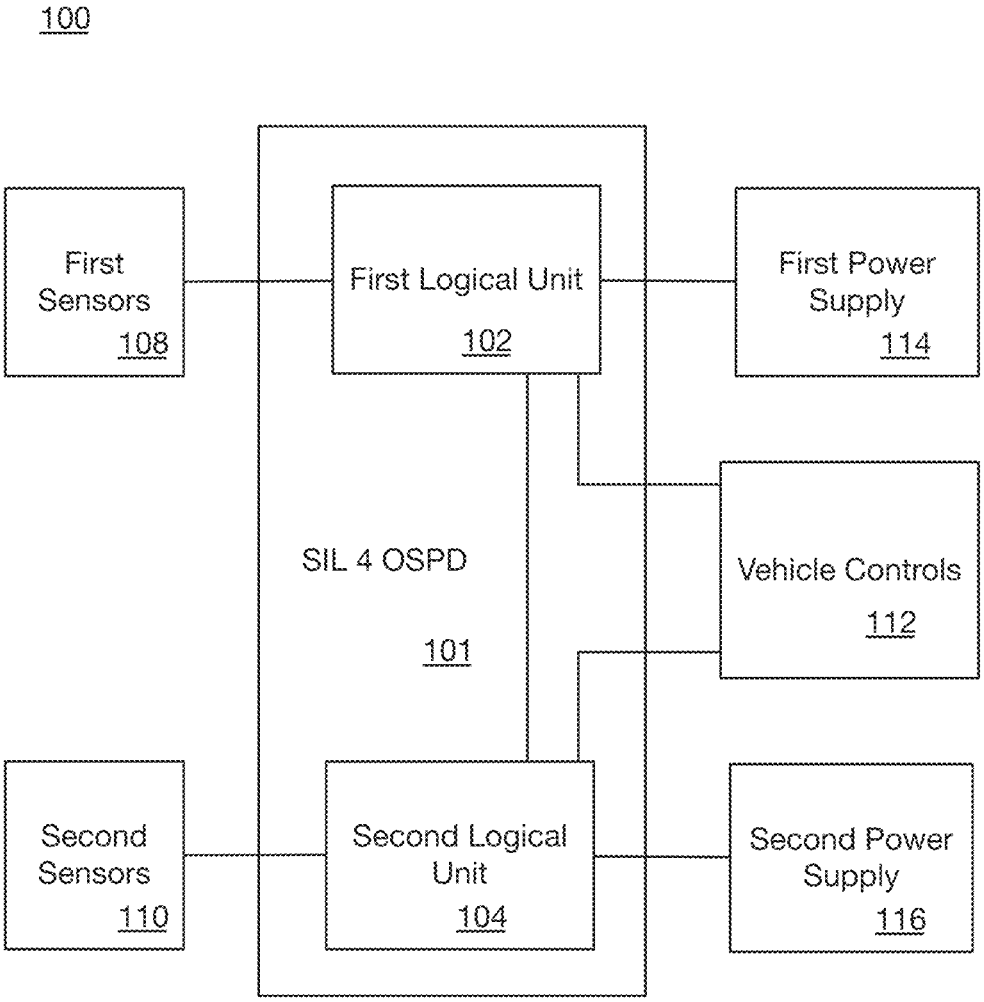
FIG. 1 is a functional block diagram of an over-speed protection device installed in a vehicle, in accordance with some embodiments.

The following disclosure provides many different embodiments, or examples, for implementing different features of the provided subject matter. Specific examples of components, values, operations, materials, arrangements, etc., are described below to simplify the present disclosure. These are, of course, merely examples and are not intended to be limiting. Other components, values, operations, materials, arrangements, or the like are contemplated. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

For an over-speed protection device to be rated as Safety Integrity Level (SIL) 4, the over-speed protection device is required to have demonstratable on-demand reliability. SIL 4 is based on the International Electrotechnical Commission's (IEC) standard IEC 61508. SIL 4 requires the probability of failure per hour to range from $10^{-8}$ to $10^{-9}$.

FIG. 1 is a functional block diagram 100 of an SIL 4 over-speed protection device installed in a vehicle, in accordance with an embodiment. SIL 4 over-speed protection device 101 includes two logical units; a first logical unit 102 and a second logical unit 104, in accordance with an embodiment. In accordance with some embodiments, there are more than two logical units. In accordance with some embodiments, the logical units 102, 104 are enclosed within a housing. In accordance with some embodiments, the logical units 102, 104 are physically separated.

The first logical unit 102 operates independently from the operation of second logical unit 104. Each logical unit receives power from a distinct power source, receives data from distinct sensors and provides output that is unaffected by the operation of the other logical unit. The first logical unit 102 is communicably coupled with and communicates with a first set of sensors 108, including a speedometer and/or a tachometer/speed sensor. The second over-speed protection device 104 is communicably coupled with and communicates with a second set of sensors 110, including a speedometer and/or a tachometer/speed sensor. In some embodiments, the communication is by a wired connection, a wireless connection, or another suitable communication connection. In accordance with an embodiment, the first set of sensors 108 are independent of the second set of sensors 110. In accordance with an embodiment, the first set of sensors 108 are of different design than the second set of sensors 110. In accordance with an embodiment, the first set of sensors 108 have distinct power sources (not shown) from the second set of sensors 110.

First logical unit 102 is communicably coupled with and communicates with vehicle controls 112. Second logical unit 104 is communicably coupled with and communicates with vehicle controls 112. In some embodiments, the communication is by a wired connection, a wireless connection, or another suitable communication connection. The vehicle controls 112 include, in accordance with various embodiments, first and second vehicle on-board controllers (VOBC), brakes, emergency brakes, an emergency brake reset input, zero velocity relays, a mode select switch and/or other suitable controls.

First logical unit 102 is electrically connected to and receives power from a first power supply 114. Second logical unit 104 is electrically connected to and receives power from a second power supply 116. In accordance with an embodiment, first power supply 114 is independent of second power supply 116, further isolating the first logical unit 102 from the second logical unit 104.

First logical unit 102 is communicably connected to and communicates with second logical unit 104. In some embodiments, the communication is a wired connection, a wireless connection, or another suitable communication connection. Each logical unit monitors the output of the other logical unit, to insure both logical units are operating properly.

In accordance with an embodiment, the SIL 4 over-speed protection device 101 operates whenever the train is in motion, even when the train control system, e.g., a communication-based train control system, is engaged and controls train functions. By operating the SIL 4 over-speed protection device 101 whenever the train is moving, the SIL 4 over-speed protection device 101 evaluates whether the logical units 102, 104 are functioning correctly and safely during train control operation so that when the logical units 102, 104 are to be used to control an over-speed situation, when the train control system is not in operation, the SIL 4 over-speed protection device 101 will perform safely, given the wide range of possible failures that over-speed protection systems and other train systems can experience. In some embodiments, possible failures include failure of a speed sensor, failure of a power supply, failure of the over-speed protection device, failure of the vital supervision circuit, a functional failure to react correctly to over-speed and/or other types of failure.

In at least one embodiment, the SIL 4 over-speed protection device 101 is used in conjunction with a communication-based train control system (CBTC). The SIL 4 over-speed protection device 101, in accordance with other embodiments, is used in conjunction with any primary control system that vitally controls the speed of the train. The SIL 4 over-speed protection device 101 provides fall back assistance in a vital manner when the primary control system CBTC fails. The SIL 4 over-speed protection device 101*d* provides a vital alternative to the primary control system and ensures that a human overspeed error will not result in an accident when the primary control system fails and control is handed over to the human operator.

The SIL 4 over-speed protection device 101 according to one or more embodiments is trusted to operate when requested, when there is a need to operate a train control system in manual mode or when the train control has failed or is otherwise not operable. Because the SIL 4 over-speed protection device 101 is operated continuously, any failure of the SIL 4 over-speed protection device 101 is detected early so that the failure is repairable before the over-speed protection function is needed.

The SIL 4 over-speed protection device 101 is a checked-redundant system that supervises the train speed in Manual and Cut Out modes of operation. A checked-redundant system relies on the operation of the two independent logical units 102 and 104 in parallel. Each logical device, e.g., logical units 102, 104, monitors the output of the other logical device, e.g., logical units 102, 104, to ensure both are operating correctly by checking to see that the other logical device is powered-on and functional and checking if the speed reported by both logical units is the same. Either logical unit shuts down the SIL 4 over-speed protection device in the event that there is any detection of a non-matching output. The CBTC or other primary control system will monitor the correct functioning of the SIL 4 over-speed protection device 101, recognize failures and react appropriately to any failures. Continued checking minimizes the window of vulnerability.

Figure 2:
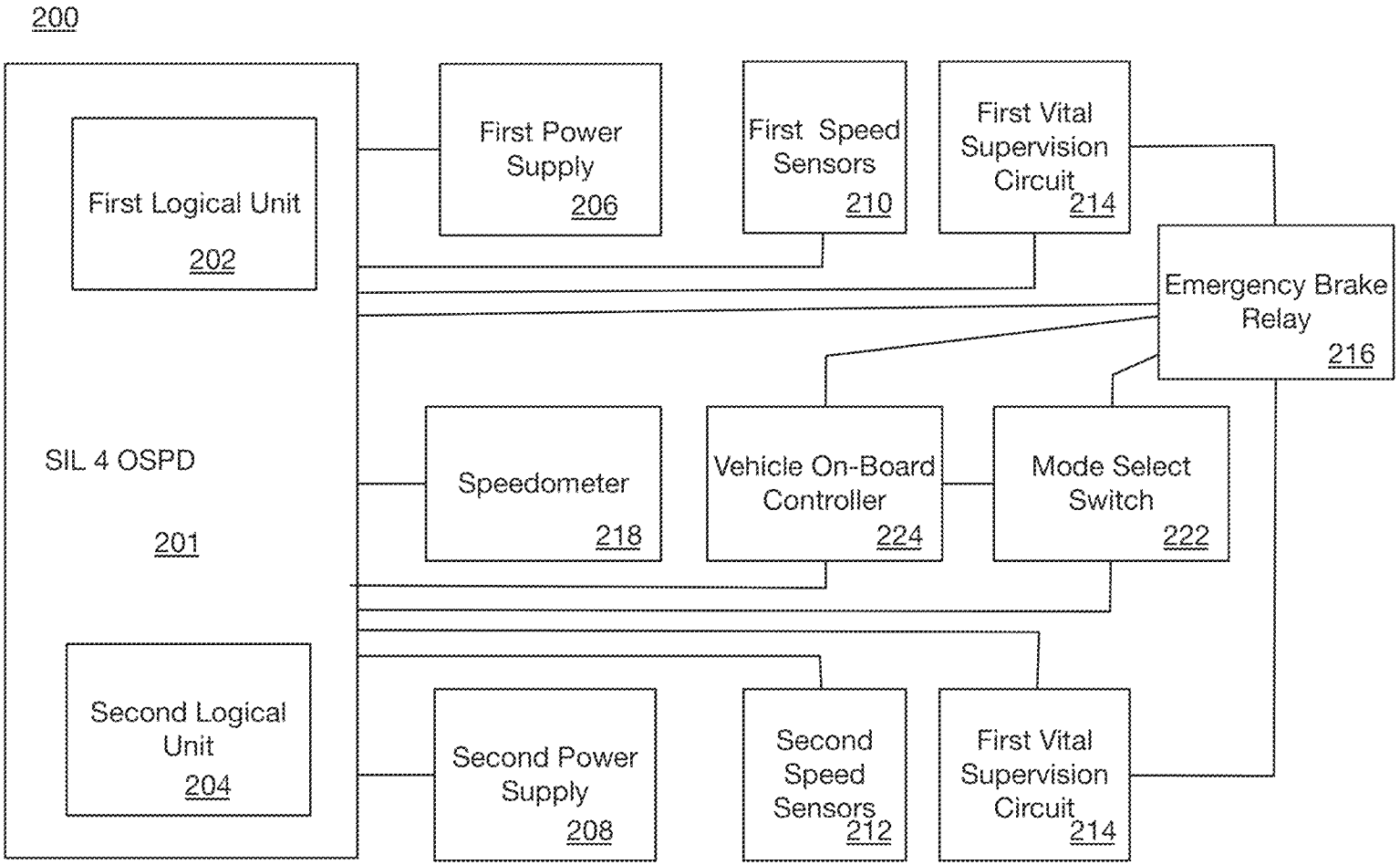
FIG. 2 is a functional block diagram of an over-speed protection device connected to supporting train systems, in accordance with some embodiments.

FIG. 2 is a functional block diagram 200 of an SIL 4 over-speed protection device 201 connected to supporting vehicle systems, in accordance with an embodiment. The SIL 4 over-speed protection device 201 includes two logical units 202 and 204. The first logical unit 202 and the second logical unit 204 are communicably connected and communicate with each other by an isolated connection (not shown). The first logical unit 202 is independent of the second logical unit 204. The first logical unit 202 is powered by a first power supply 206. The second logical unit 204 is powered by a second power supply 208. The first power supply 206 is independent of the second power supply 208 to ensure independence of the power supplied to each over-speed protection device. In some embodiments, the power supplies are DC/DC converters or the like.

A first tachometer/speed sensor 210 is communicably connected to and communicates with first logical unit 202. A second tachometer/speed sensor 212 is communicably connected to and communicates with second logical unit 204. The first tachometer/speed sensor 210 is independent of the second tachometer/speed sensor 212. The first logical unit 202 receives speed data from the first tachometer/speed sensor 210 and computes the train's speed. The second logical unit 204 receives speed data from the second tachometer/speed sensor 212 and computes the train's speed. The speed computed by the first logical unit 202 is compared to the speed computed by the second logical unit 204 to ensure that the speed information provided by the two speed measurement devices 210 and 212 are within a predetermined tolerance.

The first logical unit 202 is communicably connected to and communicates with a first vital supervision circuit 214. The second logical unit 204 is communicably connected to and communicates with a second vital supervision circuit 215. The first vital supervision circuit 214 is independent of the second vital supervision circuit. The vital supervision circuits 214 and 215 are timer circuits that monitor the outputs of the logical units 202 and 204. If the first logical unit 202 fails to respond, i.e., fails to provide data or fails to change output, after a specified time, the first vital supervision circuit will time out and send a signal to the emergency brake relays 216, causing the emergency brakes to be applied and the train to be slowed or stopped. If the second logical unit 204 fails to respond, i.e., fails to provide data or fails to change output, after a specified time, the second vital supervision circuit 215 will time out and send a signal to the emergency brake relays 216, causing the emergency brakes to be applied and the train to be slowed or stopped. The first logical unit 202 monitors the output of the first vital supervision circuit 214, the second vital supervision circuit 215 and the emergency brake relay 216 to ensure they are functioning properly. The second logical unit 204 monitors the output of the first vital supervision circuit 214 and the second vital supervision circuit 215 and the emergency brake relay 21 to ensure they are functioning properly.

The logical units 202 and 204 will be considered failed if either of the logical units 202 and 204 do not reset the vital supervision circuit timer 214 and 215 before either timer expires; the logical units 202 and 204 will be considered failed if either logical unit 202 and 204 determines that it or the other logical unit is malfunctioning. For example, a logical unit is failed if the logical unit fails to react when the reported speed exceeds the overspeed threshold and the calculated speed difference between each logical unit exceeds a specified threshold.

The SIL 4 over-speed protection device 201 is communicably connected to and communicates with a speedometer 218. The SIL 4 over-speed protection device communicates the actual speed of the train and the maximum allowed speed of operation to the speedometer 218. In accordance with an embodiment, the SIL 4 over-speed protection device 201 is connected to the speedometer 218 via an A/D circuit, not shown.

The speedometer 218 directly or indirectly (dependent on sensor type) measures speed. A tachometer sensor measures the rotation rate of the axle to which the sensor is connected. This rotation rate and the wheel diameter are combined to determine the speed. A sensor based on a radar or an optical device would directly measure of the speed of the car body with respect to its surroundings The SIL 4 over-speed protection device 201 is communicably connected to and communicates with a mode select switch 222. The mode select switch is set by the driver or a train control system to indicate whether the train is in an Automatic Mode (whereby the train control system operates the train controls), a Manual Mode (whereby the driver operates the train controls) or a Cut Off Mode (whereby the driver operates the train controls under restricted conditions). The SIL 4 over-speed protection device 201 only sends signals (or is prevented from successfully sending a signal) to the emergency brake relay when the mode select switch 222 is in Manual Mode or Cut Off Mode.

The SIL 4 over-speed protection device 201 uses data from the sensors 210, 212 to determine the actual speed of the train and is given the maximum allowed speed of operation by the vehicle on-board controller 224. If the SIL 4 over-speed protection device 201 determines that the actual speed of the train exceeds the maximum allowed speed of operation, and the mode select switch 222 is in "manual mode" or "cut off operation," a signal is sent to the emergency brake relay 216 causing the emergency brakes to be applied and the train to slow or stop. The SIL 4 over-speed protection device 201 is only able to send a signal to the emergency brake relay 216 when the mode select switch is in Manual Mode or Cut Off Mode.

If the first logical unit 202 or the second logical unit 204 determines that the actual speed of the train exceeds the maximum allowed speed of operation, the train is in an over-speed situation. If the first logical unit 202 detects an over-speed situation, the SIL 4 over-speed protection device 201 will send a signal to the emergency brake relay 216, if the mode select switch 222 is in Manual Mode or Cut Off mode. If the second logical unit 204 detects an over-speed situation, the SIL 4 over-speed protection device 201 will send a signal to the emergency brake relay 216 if the mode select switch 222 is in Manual Mode or Cut Off Mode.

The SIL 4 over-speed protection device 201 is communicably connected to and communicates with a vehicle on-board controller (VOBC) 224. The VOBC 224 monitors the outputs of the SIL 4 over-seed protection device 201. The SIL 4 over-speed protection device 201 operates at when the train is in operation, when the mode select switch 222 is in Automatic Mode, Manual Mode or Cut Off Mode. If the mode select switch 222 is in Manual Mode or Cut Off Mode, the VOBC 224 compares signals received from the SIL 4 over-speed protection device 201 and the emergency brake relay 216 to ensure the SIL 4 over-speed protection device 201 is functioning properly and sending appropriate signals to the emergency brake relay 216. If the mode select switch 222 is in Automatic Mode, during normal communication based train control operation, the VOBC 224 monitors the SIL 4 over-speed protection device to ensure the SIL 4 over-speed protection device 201 is functioning properly even though it does not send control signals to the emergency brake relay 216.

The vehicle on-board controller 224 continually checks the reactions of the SIL 4 over-speed protection device 201 without implementing the SIL 4 over-speed protection device 201 output. The vehicle on-board controller 224 validates the operation of the SIL 4 over-speed protection device 201.

In accordance with an embodiment, the SIL 4 over-speed protection device 201 generates a Zero Speed Indication when both the first speed sensors 210 and the second speed sensors 212 indicate a lack of motion of the vehicle for a predetermined period of time, for example 0.25 seconds. The Zero Speed Indication generated by the SIL 4 over-speed protection device 201 is used for door control, so that the doors of the train only open when the train is not in motion. In accordance with an embodiment, the dual over-speed protection module 201 detects and outputs a vital Zero Speed Indication to ensure doors are not allowed to open while in motion. The Zero Speed Indication is output when both the first speed sensors 210 and the second speed sensors 212 indicate lack of motion of the vehicle for a predetermined period of time, for example, 0.25 seconds.

The first logical unit 202 and the second logical unit 204 are connected to the power supplies 206 and 208, the speed sensors 210 and 212 and the vital supervision circuits 214 and 215 through isolated output/inputs to allow a checked-redundant verification. The SIL 4 over-speed protection device 201 verifies that the speed provided by the speed sensors 212 and 210 are within a predetermined tolerance. The SIL 4 over-speed protection device 201 verifies that the detection of an overspeed situation is the same in both logical units 202 and 204. The SIL 4 over-speed protection device 201 verifies that the speed provided to the speedometer is the same in both logical units 202 and 204.

When the mode select switch is in Manual Mode or Cut Off Mode, and the SIL 4 over-speed protection device determines an overspeed situation, a control signal is sent to the emergency brake relay, causing the emergency brakes to be applied and the train to slow or stop.

During station stops, first logical unit 202 checks the input from the first speed sensors 210 to ensure the first speed sensors 210 are functional and second logical unit 204 checks the input from the second speed sensors 212 to ensure the second speed sensors 212 are functional.

When the driver switches the mode select switch into Manual Mode or Cut Off Mode, the SIL 4 over-speed protection device 201 initially sends a control signal to the emergency brake relay 216 to apply the emergency brakes and slow or stop the train. The SIL 4 over-speed protection device 201 will then send a control signal to the emergency brake relay 216 to allow manual operation if the actual speed of the train is less than the maximum speed of operation. The VOBC 224 is communication based train control on-board automatic train protection equipment. The VOBC 224 continually monitors the operation of the SIL 4 over-speed protection device 201. The VOBC 224 is an independent SIL 4 device. When the SIL 4 over-speed protection device 201 is powered-up, the first logical unit 202 and the second logical unit perform self-test procedures. The first logical unit 202 checks that the second logical unit 204 is operational by an isolated connection and by checking the second vital supervision circuit 215. The second logical unit 204 checks that the first logical unit 202 is operational by an isolated connection and by checking the first vital supervision circuit 214. The design provides a SIL 4 safety level by implementing diverse design of the logical units 202 and 204 of the SIL 4 over-speed protection device 201, a checked-redundant design, independent power supplies 206, 208 and tachometer/speed sensors 210, 212, and vital supervision circuits 214, 215 acting as watch dog timers to ensure that each logical unit operates correctly. Once the vital supervision circuit 214, 215 is de-activated, a powered rest for the SIL 4 over-speed protection device 201 is commanded to allow further operation of the unit. The design provides a SIL 4 safety level by implementing supervision of the operation of the SIL 4 over-speed protection device 201 by the VOBC 224, a SIL 4 device. The design provides a SIL 4 safety level by implementing independent inputs and outputs for the first and second logical units 202 and 204.

By implementing multiple logical units 202 and 204, the logical units 202 and 204 are able to monitor the operations of the other logical unit and ensure safety. This provides for a dual level of supervision for the detection of failures of any of the logical units. Failure of a tachometer/speed sensor 210, 212 is detected by each of the logical units because the logical units can compare the speeds determined from data provided by the speed sensors 210, 212. Failure of a power supply 206, 208, causing one of the logical units 202, 204 to fail, is detected by the other over-speed protection device 202, 204 and the VOBC 224 when the outputs of the failed logical unit indicate failure, e.g., by failure to respond, failure to provide data (such as a heartbeat signal) or failure to change outputs in changing conditions. Failure of logical unit 202, 204 is detected by the other logical unit and the VOBC 224 when the outputs of the failed logical unit indicate failure by failure to respond, failure to provide data (such as a heartbeat signal) or failure to change outputs in changing conditions. Failure of the first vital supervision circuit 214 is detected by the associated logical unit 202, the other logical unit 204 and the VOBC 224 when the output of the first vital supervision circuit 214 indicates failure, e.g., by failure to respond, failure to provide data (such as a heartbeat signal) or failure to change outputs in changing conditions. Functional failure to react correctly to over-speed is detected by the VOBC 224 when the output of the SIL 4 over-speed protection device 201 does not match the state of the emergency brake relay 216.

The VOBC 224 is a communication-based train control train/vehicle on-board controller that provides Automatic Train Protection functions (as defined in IEEE 1474.1). The VOBC 224 monitors and supervises the correct operation of the SIL 4 over-speed protection device 201 when in communication-based train control territory. The active VOBC 224 is the VOBC which supervises the operation of the SIL 4 over-speed protection device 201.

A vital supervision circuit 214, 215 provides a control signal generated by a safety circuit (watch dog timer circuit) to energize the emergency brakes 216. When the circuit is energized the vital supervision circuit 214, 215 is providing power to the outputs of the SIL 4 over-speed protection device 201. The vital supervision circuit 214, 215 is Class I (vital) hardware, the failure of which, can adversely affect system safety. Vital hardware is hardware whose failure modes and characteristics can be accurately identified, predicted and exhaustively tested. The occurrence of failure modes that could have unsafe consequences are eliminated, prevented or otherwise accounted for by design; they are not accounted for statistically. The vital supervision circuits 214, 215 provide fail safe operation.

The logical units 202 and 204 are configured as checked-redundant and supervise each other so that if one logical unit fails, the failure is detected by the other logical unit and a shutdown of the SIL 4 over-speed protection device 201 occurs.

A tachometer/speed sensor 210, 212, in accordance with an embodiment, is a device attached to a wheel which provides an electric pulse to the VOBC 224. The frequency of the electric pulse depends on the speed of the train. In at least some embodiments, there are two electric interfaces to each tachometer 210, 212 where the two phases of each tachometer are shifted by 180 degrees. The two pulse trains provide independent speed pulse trains to each of the over-speed protection devices 202, 204. The shift of 180 degrees ensures that at all times one phase of each tachometer/speed sensor 210, 212 is always in the high state so that the logical units 202, 204 can determine at all times while the train is stopped that the tachometer/speed sensor 210, 212 is powered and at least one phase of the independent pulse train is energized and working.

The SIL 4 over-speed protection device 201 includes two logical units 202 and 204 in a checked redundant configuration. The SIL 4 over-speed protection device 201 includes two logical units 202 and 204 in a checked redundant configuration. In at least some embodiments, OSPD 201 includes more than two logical units. In accordance with an embodiment, the logical units 202 and 204 are of diverse technologies and manufacture, to ensure elimination of common failure modes.

The SIL 4 over-speed protection device 201 operates to monitor overspeed situations whenever the device is powered, even though the SIL 4 over-speed protection device 201 only sends control signals to the emergency brake relay 216 when the mode select switch 222 is in Manual Mode or Cut Off Mode. Because the SIL 4 over-speed protection device 201 is always operational, the driver can be certain that the SIL 4 over-speed protection device 201 is available when needed.

When the mode select switch is in Automatic Mode, the train is controlled by the train control system, the SIL 4 over-speed protection device 201 is unable to send control signals to the emergency brake relay 216. The SIL 4 over-speed protection device 201 continues to monitor the speed of the train and is monitored for correct operation by the VOBC 224. This ensures that the SIL 4 over-speed protection device 201 is functioning regardless of the mode.

An SIL 4 device, the VOBC 224 controls communication-based train control and monitors the operation of the SIL 4 over-speed protection device 201 at all-times during communication-based train control operation. This assures that the SIL 4 over-speed protection device 201 not only goes through its checked redundancy supervisions but also the results are continuously monitored by the VOBC 224.

A checked-redundant configuration of an over-speed protection device, in accordance with an embodiment, is rendered in a hardware configuration based on one or more of a microcontroller, complex programmable logical device or floating point gate array.

The SIL 4 over-speed protection device 201 operates continuously, even in communication-based train control mode of operation and when not needed, to ensure that the device is operating correctly. The SIL 4 over-speed protection device 201 goes through supervision on a cyclic basis as the train moves between stations. A typical application cycle is 70 ms and typically a number of checks are performed at this frequency. For example, each logical unit 202, 204 checks the status of its connected sensors 210, 212, the status of its power supply 206, 208, the temperature of the internal processor (not shown) and the status of the vital supervision circuits 214, 215. Each logical unit 202, 204 will calculate a speed and cross compare with the speed calculated by the other logical unit 204, 202. Other cyclic activities include checking the integrity synchronization mechanism and the memory and processor (not shown). The frequency of a check redundant system is usually determined from the analysis of the failure modes of the components making up the system. In order to meet the vitality failure rate of the SIL 4 overspeed protection device 201 the checking process must ensure that undetected failures will not affect the vitality of the SIL 4 overspeed protection device.

Figure 3:
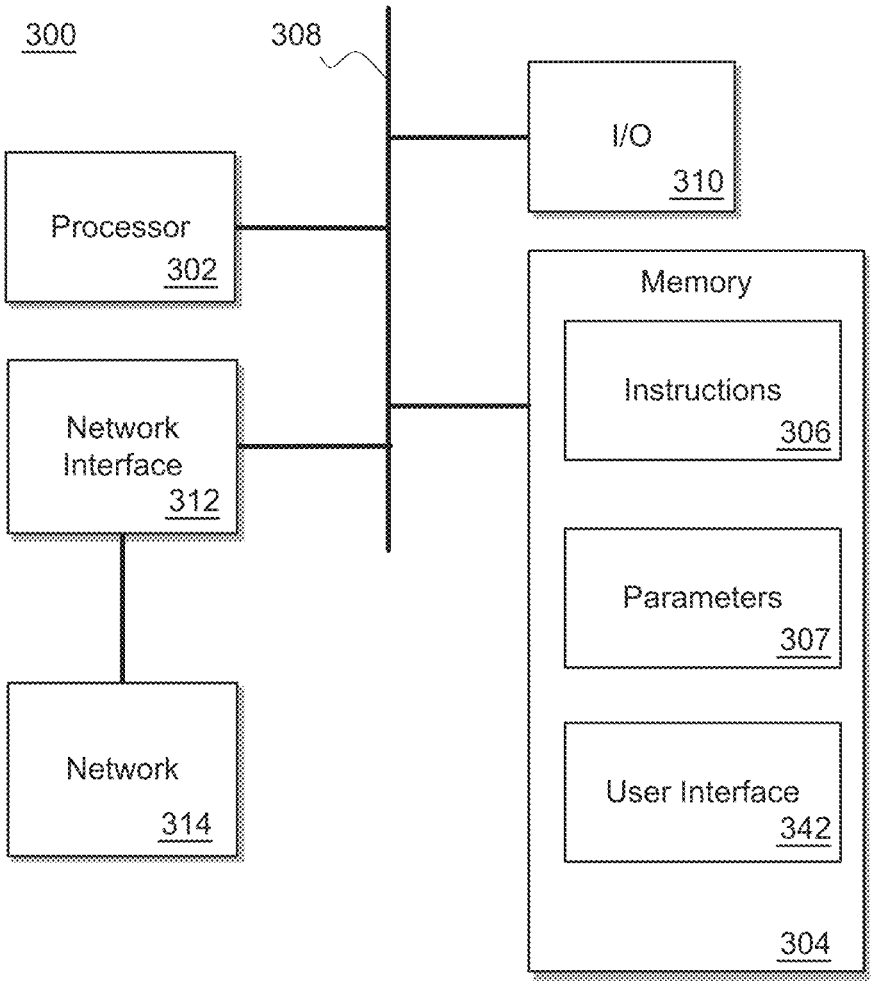
FIG. 3 is a high-level block diagram of a processor-based system usable in conjunction with one or more embodiments.

FIG. 3 is a block diagram of processor-based system 300 in accordance with some embodiments. In some embodiments processor-based system 300 is usable as over-speed protection device, such as over-speed protection device 102 in FIG. 1.

In some embodiments, processor-based system 300 is a general purpose computing device including a hardware processor 302 and a non-transitory, computer-readable storage medium 304. In some embodiments, system 300 could be used as all or part of VOBC 114 (FIG. 1). Storage medium 304, amongst other things, is encoded with, i.e., stores, computer program code 306, i.e., a set of executable instructions. Execution of instructions 306 by hardware processor 302 represents (at least in part) an over-speed protection device 102 which implements a portion or all of the methods described herein in accordance with one or more embodiments (hereinafter, the noted processes and/or methods).

Processor 302 is electrically coupled to computer-readable storage medium 304 via a bus 308. Processor 302 is also electrically coupled to an I/O interface 310 by bus 308. A network interface 312 is also electrically connected to processor 302 via bus 308. Network interface 312 is connected to a network 314, so that processor 302 and computer-readable storage medium 304 are capable of connecting to external elements via network 314. Processor 302 is configured to execute computer program code 306 encoded in computer-readable storage medium 304 in order to cause system 300 to be usable for performing a portion or all of the noted processes and/or methods. In one or more embodiments, processor 302 is a central processing unit (CPU), a multi-processor, a distributed processing system, an application specific integrated circuit (ASIC), and/or a suitable processing unit.

In one or more embodiments, computer-readable storage medium 304 is an electronic, magnetic, optical, electromagnetic, infrared, and/or a semiconductor system (or apparatus or device). For example, computer-readable storage medium 304 includes a semiconductor or solid-state memory, a magnetic tape, a removable computer diskette, a random access memory (RAM), a read-only memory (ROM), a rigid magnetic disk, and/or an optical disk. In one or more embodiments using optical disks, computer-readable storage medium 304 includes a compact disk-read only memory (CD-ROM), a compact disk-read/write (CD-R/W), and/or a digital video disc (DVD).

In one or more embodiments, storage medium 304 stores computer program code 306 configured to cause system 300 (where such execution represents (at least in part) the over-speed protection device 102) to be usable for performing a portion or all of the noted processes and/or methods. In one or more embodiments, storage medium 304 also stores information which facilitates performing a portion or all of the noted processes and/or methods. In one or more embodiments, storage medium 304 stores data 307 such as the maximum allowed speed and other parameters disclosed herein.

System 300 includes I/O interface 310. I/O interface 310 is coupled to external circuitry. In one or more embodiments, I/O interface 310 includes a keyboard, keypad, mouse, trackball, trackpad, touchscreen, and/or cursor direction keys for communicating information and commands to processor 302.

Processor-based system 300 also includes network interface 312 coupled to processor 302. Network interface 312 allows system 300 to communicate with network 314, to which one or more other computer systems are connected. Network interface 312 includes wireless network interfaces such as BLUETOOTH, WIFI, WIMAX, GPRS, or WCDMA; or wired network interfaces such as ETHERNET, USB, or IEEE-1364. In one or more embodiments, a portion or all of noted processes and/or methods is implemented in two or more systems 300.

System 300 is configured to receive information through I/O interface 310. The information received through I/O interface 310 includes one or more of instructions, data, design rules, libraries of standard cells, and/or other parameters for processing by processor 302. The information is transferred to processor 302 via bus 308. processor-based system 300 is configured to receive information related to a UI through I/O interface 310. The information is stored in computer-readable medium 304 as user interface (UI) 342.

In some embodiments, a portion or all of the noted processes and/or methods is implemented as a standalone software application for execution by a processor. In some embodiments, a portion or all of the noted processes and/or methods is implemented as a software application that is a part of an additional software application. In some embodiments, a portion or all of the noted processes and/or methods is implemented as a plug-in to a software application. In some embodiments, at least one of the noted processes and/or methods is implemented as a software application that is a portion of an over-speed protection device system 102. In some embodiments, a portion or all of the noted processes and/or methods is implemented as a software application that is used by processor-based system 300.

In some embodiments, the processes are realized as functions of a program stored in a non-transitory computer readable recording medium. Examples of a non-transitory computer readable recording medium include, but are not limited to, external/removable and/or internal/built-in storage or memory unit, e.g., one or more of an optical disk, such as a DVD, a magnetic disk, such as a hard disk, a semiconductor memory, such as a ROM, a RAM, a memory card, and the like.

Figure 4:
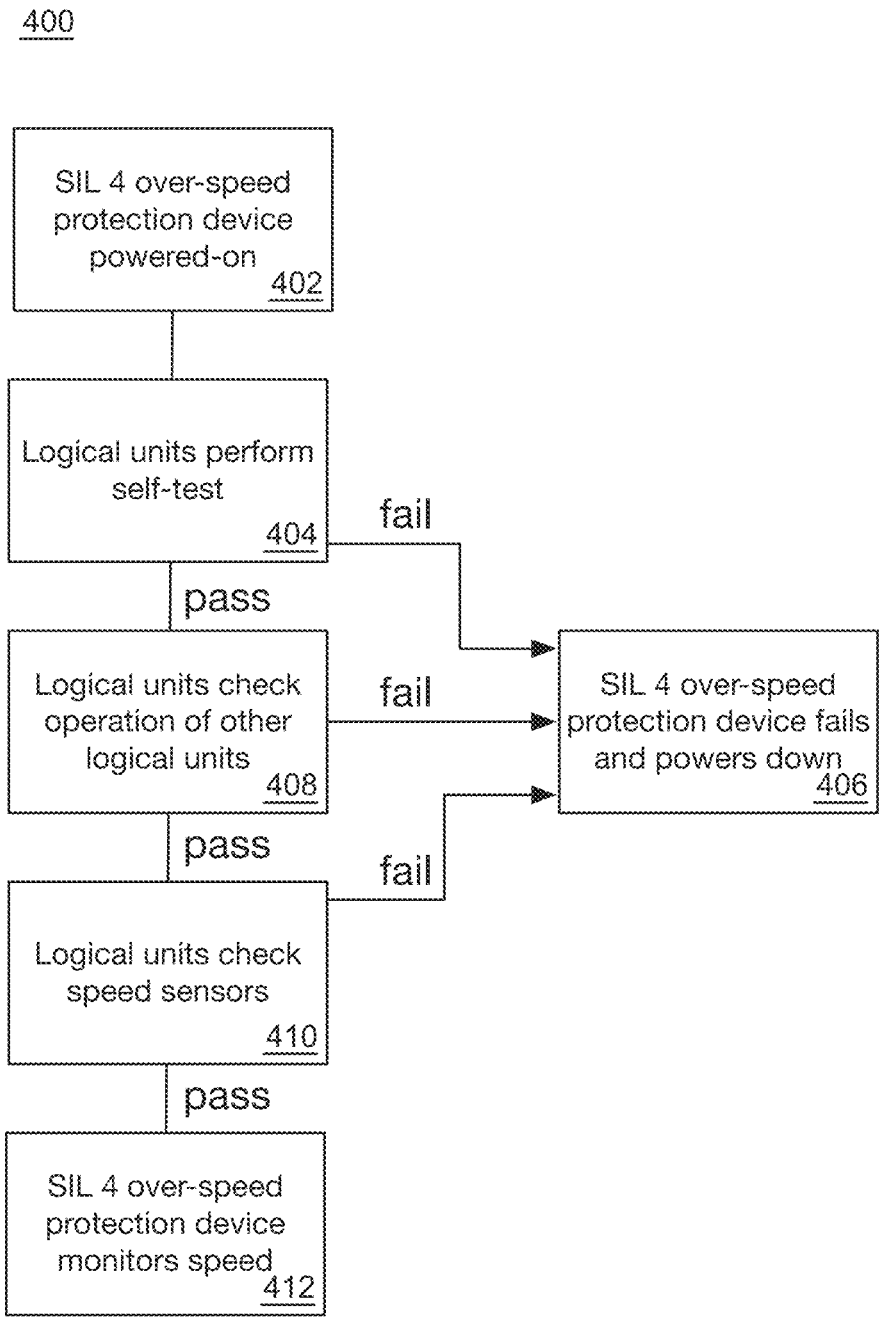
FIG. 4 is a flow chart of the over-speed protection device initialization, in accordance with some embodiments.

FIG. 4 is a flowchart 400 of the SIL 4 over-speed protection device initialization, in accordance with some embodiments. The SIL 4 over-speed protection device is powered on in step 402. The logical units perform a self-test procedure in step 404. The self-test procedure includes checking the status of its connected sensors, the status of its power supply, the temperature of the processor and the status of the vital supervision circuits. If the self-test procedures indicate that the logical unit has failed, the SIL 4 over-speed protection device fails and the system powers down in step 406. If the self-test procedures indicate that the logical units are functional, each logical unit checks the operational status of the other logical units in step 408. If one of the logical units is not operational, the SIL 4 over-speed protection device fails and the system powers down in step 406. If the logical units are operational, the logical units check the operational status of the speed sensors in step 410. If any of the speed sensors are not operational, the SIL 4 over-speed protection device fails and the system powers down in step 406. If the speed sensors are all operational, the SIL 4 over-speed protection device monitors the train speed in step 412.

Figure 5:
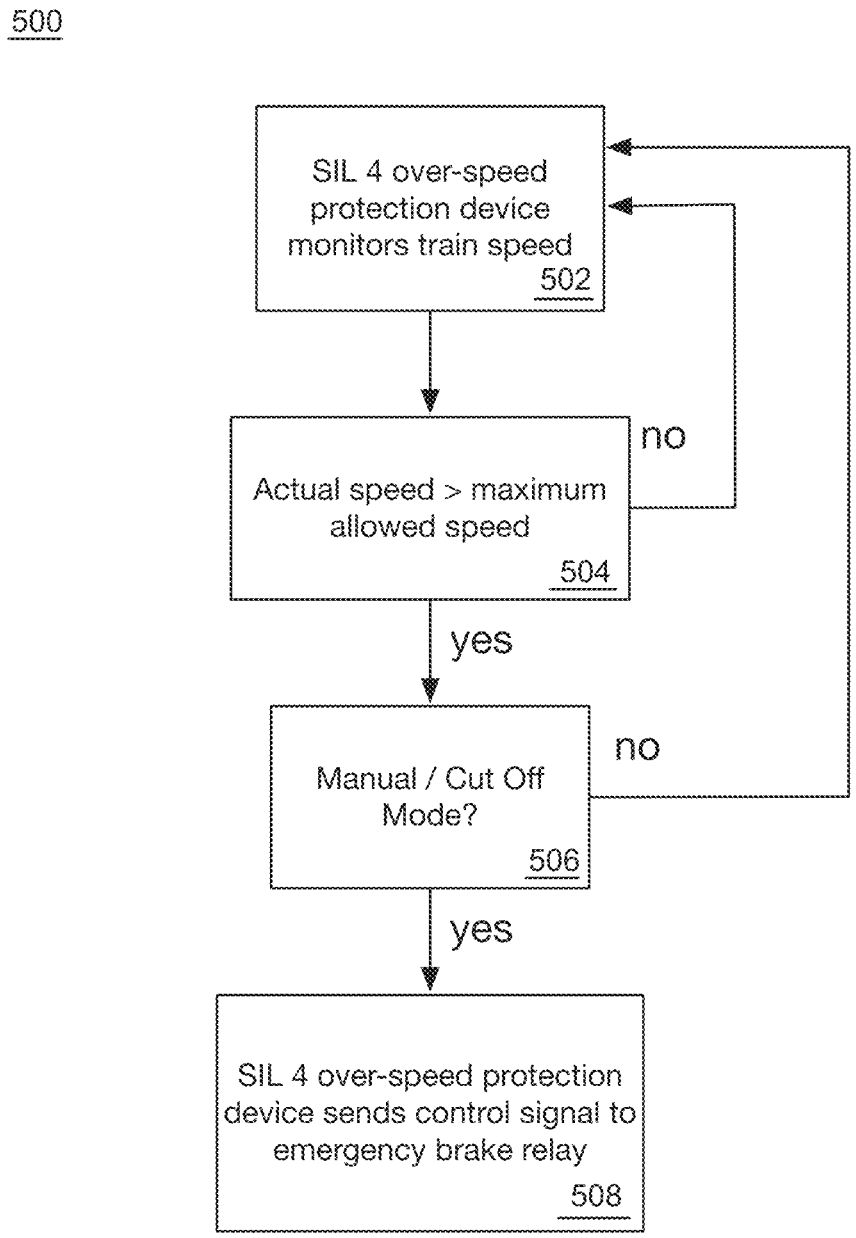
FIG. 5 is a flow chart of the over-speed protection device operation, in accordance with some embodiments.

FIG. 5 is a flow chart 500 of the SIL 4 over-speed protection device operation, in accordance with some embodiments. The SIL 4 over-speed protection device monitors train speed in step 502, e.g., OSPD 101 receives a speed signal indicative of the speed of the vehicle from first and second sensors 108, 110. The SIL 4 over-speed protection device checks to see if the actual speed of the train exceeds the maximum allowed speed in step 504. If the actual speed of the train does not exceed the maximum allowed speed, the SIL 4 over-speed protection device continues to monitor the train speed in step 502. If the actual speed of the train exceeds the maximum allowed speed, the SIL over-speed protection device checks to see if the train controls are in Manual Mode or Cut Off Mode in step 506. If the train controls are not in Manual Mode or Cut Off Mode, the SIL 4 over-speed protection device continues to monitor the train's speed in step 502, e.g., OSPD 101 receives a speed signal indicative of the speed of the vehicle from first and second sensors 108, 110. If the train controls are in Manual Mode or Cut Off Mode, the SIL 4 over-speed protection device sends a control signal to the emergency brake relay in step 508, causing the emergency brakes to be applied and the train to slow or stop.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. An SIL 4 over-speed protection device for a rail vehicle, the device comprising:

a first logical unit configured to be connected to a first power source, a first speed sensor and a first vital supervision circuit; and a second logical unit configured to be connected to a second power source, a second speed sensor and a second vital supervision circuit;

wherein the first logical unit is configured to monitor the output of the second logical unit and the second logical unit is configured to monitor the output of the first logical unit.

2. The SIL 4 over-speed protection device of claim 1, wherein the first logical unit and the second logical unit are connected to a vehicle on-board controller.

3. The SIL 4 over-speed protection device of claim 1, wherein when the first logical unit or the second logical unit detects an over-speed condition, the over-speed protection device is configured to engage a brake.

4. The over-speed protection system of claim 1, wherein the first logical unit and the second logical unit determine speed using different methods.

5. The SIL 4 over-speed protection device of claim 1, wherein the first power source is independent of the second power source.

6. The SIL 4 over-speed protection device of claim 1, wherein the first speed sensor and the second speed sensor measure speed using different methods.

7. The SIL 4 over-speed protection device of claim 1, wherein the first speed sensor is independent of the second speed sensor.

8. The SIL 4 over-speed protection device of claim 2, wherein the vehicle on-board controller is configured to supervise the first logical unit and the second logical unit.

9. The SIL 4 over-speed protection device of claim 1, wherein the first vital supervision circuit is configured to ensure that the first logical unit measures speed accurately and the second vital supervision circuit is configured to ensure that the second logical unit measures speed accurately.

10. The SIL 4 over-speed protection device of claim 1, wherein the first logical unit has first inputs and first outputs and the second logical unit has second inputs and second outputs and wherein the first inputs are independent of the second inputs and the first outputs are independent of the second outputs.

11. A rail vehicle, comprising:

an SIL 4 over-speed protection device including a first logical unit and a second logical unit;

a vehicle on-board controller connected to the SIL 4 over-speed protection device a mode selection switch in communication with the SIL 4 over-speed protection device and the vehicle on-board controller, the mode selection switch being set by a train control system or an operator and configured to select between at least two modes responsive to detection of an over-speed condition:

a first mode wherein the first mode is an automatic mode whereby a train control system operates train controls and in which the SIL 4 over-speed protection device engages a brake; and a second mode wherein the second mode is a manual mode whereby the operator operates the train controls and in which the SIL 4 over-speed protection device does not engage a brake.

12. The rail vehicle of claim 11, wherein the SIL 4 over-speed protection device is configured to detect a zero speed.

13. The rail vehicle of claim 11, wherein the SIL 4 over-speed protection device is a checked redundant system.

14. The rail vehicle of claim 11, wherein the SIL 4 over-speed protection device is configured to test the first and second logical units.

15. The rail vehicle of claim 11, further comprising a first speed sensor connected to the first logical unit and a second speed sensor connected to the second logical unit.

16. The rail vehicle of claim 11, further comprising a first power source connected to the first logical unit and a second power source connected to the second logical unit.

17. The rail vehicle of claim 11, further comprising a first vital supervision circuit connected to the first logical unit and a second vital supervision circuit connected to the second logical unit.

18. The rail vehicle of claim 11, wherein the first logical unit and the second logical unit are checked redundant.

19. The rail vehicle of claim 11, further comprising a vehicle on-board controller connected to the first logical unit and the second logical unit.

20. The rail vehicle of claim 19, wherein the vehicle on-board controller monitors the first logical unit and the second logical unit in both the first mode and the second mode.

* * * * *